US008192311B2

(12) United States Patent
White et al.

(10) Patent No.: US 8,192,311 B2
(45) Date of Patent: Jun. 5, 2012

(54) SPORT BALL WITH A TEXTILE RESTRICTION STRUCTURE

(75) Inventors: Vincent F. White, Beaverton, OR (US); Geoffrey C. Raynak, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 94 days.

(21) Appl. No.: 12/147,799

(22) Filed: Jun. 27, 2008

(65) Prior Publication Data

US 2009/0325746 A1 Dec. 31, 2009

(51) Int. Cl.
*A63B 41/08* (2006.01)

(52) U.S. Cl. ..... 473/605; 473/598; 473/603

(58) Field of Classification Search ..... 473/603–605, 473/607, 608, 598, 601, 602
See application file for complete search history.

(56) References Cited

U.S. PATENT DOCUMENTS

| | | | | | |
|---|---|---|---|---|---|
| 414,748 | A | | 11/1889 | Bentley | |
| 1,517,859 | A | | 12/1924 | O'Shea | |
| 1,575,281 | A | | 3/1926 | Rosenberg | |
| 1,917,535 | A | | 7/1933 | Maynard | |
| 1,926,615 | A | * | 9/1933 | Drohnn | 473/610 |
| 1,932,226 | A | | 10/1933 | Pierce | |
| 1,967,908 | A | | 7/1934 | Sneary | |
| 2,012,376 | A | | 8/1935 | Caro | |
| 2,018,559 | A | | 10/1935 | Homer | |
| 2,061,604 | A | * | 11/1936 | Winterbauer | 473/605 |
| 2,080,894 | A | | 5/1937 | Levinson | |
| 2,126,220 | A | | 8/1938 | Scudder | |
| 2,129,237 | A | * | 9/1938 | Riddell | 473/605 |
| 2,142,414 | A | * | 1/1939 | Riddell | 473/610 |
| 2,221,534 | A | * | 11/1940 | Voit et al. | 473/604 |
| 2,300,441 | A | | 11/1942 | Voit et al. | |
| 2,305,409 | A | * | 12/1942 | Crowley | 473/610 |
| 2,317,939 | A | * | 4/1943 | Riddell | 473/604 |
| 2,325,073 | A | | 7/1943 | Reach | |
| 2,344,638 | A | | 3/1944 | Reeder | |
| 2,579,294 | A | * | 12/1951 | Brown | 473/605 |
| 2,609,202 | A | * | 9/1952 | Winterbauer | 473/604 |
| 2,653,818 | A | * | 9/1953 | Tebbetts, Jr. et al. | 473/604 |
| 2,945,693 | A | | 7/1960 | Way | |
| 3,512,777 | A | | 5/1970 | Henderson | |

(Continued)

FOREIGN PATENT DOCUMENTS

| | | |
|---|---|---|
| EP | 0598542 | 5/1994 |

(Continued)

OTHER PUBLICATIONS

Invitation to Pay Additional Fees and Partial International Search for PCT/US009/045392, mailed Jul. 22, 2009.

(Continued)

*Primary Examiner* — Steven Wong
(74) *Attorney, Agent, or Firm* — Plumsea Law Group, LLC

(57) ABSTRACT

A sport ball may include a casing, a restriction structure, and a bladder. The casing forms at least a portion of an exterior surface of the ball. The restriction structure is located within the casing and includes a textile element having a seamless portion with a non-planar configuration. The bladder is also located within the casing. The textile element may be a knitted fabric. Although the restriction structure may be seamless, the restriction structure may also include at most one seam or multiple seams that joins edges of the textile element. In addition, the seamless portion of the textile element may cover at least thirty percent or more of the surface of the bladder.

23 Claims, 13 Drawing Sheets

U.S. PATENT DOCUMENTS

| | | | | | |
|---|---|---|---|---|---|
| 4,154,789 | A | | 5/1979 | Delacoste | |
| 4,187,134 | A | * | 2/1980 | Svub et al. | 473/605 |
| 4,258,917 | A | * | 3/1981 | Murphy | 473/609 |
| 4,436,276 | A | | 3/1984 | Donahue | |
| 4,610,071 | A | | 9/1986 | Miller | |
| 4,660,831 | A | * | 4/1987 | Kralik | 473/603 |
| 4,856,781 | A | * | 8/1989 | Shishido et al. | 473/603 |
| D322,105 | S | | 12/1991 | Ma | |
| 5,123,659 | A | | 6/1992 | Williams | |
| 5,181,717 | A | | 1/1993 | Donntag et al. | |
| 5,250,070 | A | | 10/1993 | Parodi | |
| 5,294,112 | A | * | 3/1994 | Smith | 473/610 |
| 5,305,620 | A | * | 4/1994 | Yabuta | 66/109 |
| 5,494,625 | A | | 2/1996 | Hu | |
| 5,503,699 | A | | 4/1996 | Ratner et al. | |
| 5,603,497 | A | | 2/1997 | Louez | |
| 5,888,157 | A | | 3/1999 | Guenther et al. | |
| 6,012,997 | A | | 1/2000 | Mason | |
| 6,109,068 | A | * | 8/2000 | Stoll et al. | 66/70 |
| 6,116,057 | A | * | 9/2000 | Roell | 66/70 |
| 6,122,937 | A | * | 9/2000 | Roell | 66/70 |
| 6,142,897 | A | | 11/2000 | Lees | |
| 6,261,400 | B1 | | 7/2001 | Kennedy, III | |
| 6,302,815 | B1 | | 10/2001 | Shishido et al. | |
| 6,461,461 | B2 | | 10/2002 | Kennedy, III | |
| 6,629,902 | B2 | | 10/2003 | Murphy et al. | |
| 6,645,099 | B2 | | 11/2003 | Gaff et al. | |
| 6,685,585 | B2 | | 2/2004 | Shishido et al. | |
| 6,726,582 | B1 | | 4/2004 | Kuo et al. | |
| 6,971,965 | B1 | | 12/2005 | Shishido | |
| 6,991,569 | B2 | | 1/2006 | Dobrounig | |
| 7,005,025 | B2 | | 2/2006 | Summers | |
| 7,029,407 | B2 | | 4/2006 | Lee et al. | |
| 7,066,853 | B2 | | 6/2006 | Chang | |
| 2,073,766 | A1 | | 10/2008 | Suzuki | |
| 2001/0001925 | A1 | * | 5/2001 | Roell | 66/64 |
| 2001/0005702 | A1 | * | 6/2001 | Dobrounig | 473/599 |
| 2002/0086749 | A1 | | 7/2002 | Ou | |
| 2003/0073527 | A1 | | 4/2003 | Ou Chen | |
| 2003/0203780 | A1 | | 10/2003 | Guenther et al. | |
| 2004/0077288 | A1 | | 4/2004 | Krysiak et al. | |
| 2004/0144477 | A1 | | 7/2004 | Taniguchi et al. | |
| 2004/0229722 | A1 | | 11/2004 | Liu | |
| 2005/0081982 | A1 | | 4/2005 | Chen | |
| 2005/0229985 | A1 | | 10/2005 | Saxenfelt | |
| 2006/0063622 | A1 | | 3/2006 | Nurnberg et al. | |
| 2006/0229149 | A1 | | 10/2006 | Goedoen | |
| 2006/0293132 | A1 | | 12/2006 | Laliberty et al. | |
| 2007/0049434 | A1 | | 3/2007 | Maziarz et al. | |
| 2011/0177895 | A1 | * | 7/2011 | Lin | 473/605 |
| 2011/0237368 | A1 | * | 9/2011 | Lin | 473/603 |

FOREIGN PATENT DOCUMENTS

| | | |
|---|---|---|
| FR | 2572674 | 5/1986 |
| GB | 462853 | 3/1937 |
| JP | 10337341 | 12/1998 |

OTHER PUBLICATIONS

International Search Report and Written Opinion for PCT/US2009/045392, mailed Oct. 6, 2009.

* cited by examiner

SPORT BALL WITH A TEXTILE RESTRICTION STRUCTURE

BACKGROUND

A variety of inflatable sport balls, such as a soccer ball, conventionally exhibit a layered structure that includes a casing, a restriction structure, and an inflatable bladder. The casing provides an exterior layer of the sport ball and is generally formed from a plurality of durable, wear-resistant panels joined together along abutting edges. Although panel configurations may vary significantly, the casing of a traditional soccer ball includes thirty-two panels, twelve of which have a pentagonal shape and twenty of which have a hexagonal shape. The restriction structure forms a middle layer of the sport ball and is positioned between the bladder and the casing. In general, the restriction structure is formed from materials with a limited degree of stretch in order to restrict expansion of the bladder, as discussed in greater detail below. The bladder, which has an inflatable configuration, is located within the restriction structure to provide an inner layer of the sport ball. In order to facilitate inflation (i.e., with air), the bladder generally includes a valved opening that extends through each of the restriction structure and casing, thereby being accessible from an exterior of the sport ball.

Inflation of the bladder induces the sport ball to take on a substantially spherical shape. More particularly, fluid pressure from air within the bladder causes the bladder to expand and place an outward force upon the restriction structure. In turn, the restriction structure places an outward force upon the casing. In order to limit expansion of the bladder and also limit tension in the casing, the restriction structure generally has a configuration or is formed from a material with a limited degree of stretch. In other words, the bladder expands within the restriction structure, but the stretch characteristics of the restriction structure effectively prevent the expansion from inducing significant tension in the casing. Accordingly, the restriction structure acts to restrain the expansion of the bladder, while permitting outward forces from the bladder to induce a substantially spherical shape in the casing, thereby imparting a substantially spherical shape to the sport ball.

The restriction structures of conventional sport balls may have a variety of configurations. As an example, a conventional restriction structure may be formed from a thread, yarn, or filament that is repeatedly wound around the bladder in various directions to form a mesh that restrains expansion of the bladder. As another example, a conventional restriction structure may be formed from a plurality of generally flat or planar textile elements that are stitched together to form a structure that extends around the bladder. As yet another example, a conventional restriction structure may be formed from a plurality of generally flat or planar textile strips that are impregnated with latex and placed in an overlapping configuration around the bladder. In some conventional sport balls, the restriction structure may also be bonded, joined, or otherwise incorporated into the casing as a backing material.

SUMMARY

Features of a sport ball disclosed below relate to a casing, a restriction structure, and a bladder of the sport ball. The casing forms at least a portion of an exterior surface of the ball. The restriction structure is located within the casing and includes a textile element having a seamless portion with a non-planar configuration. The bladder is located within the restriction structure.

The textile element may be a knitted fabric. In some configurations, the textile element has a first course and a second course, the first course being adjacent to the second course, and the first course having a greater number of wales than the second course. Although the restriction structure may be seamless, the restriction structure may also include at most one seam or multiple seams that joins edges of the textile element. In addition, the seamless portion of the textile element may cover at least thirty percent or more of a surface of the bladder.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various configurations of a sport ball having a textile restriction structure. Although the sport ball is discussed and depicted as having the configuration of a soccer ball, concepts associated with the textile restriction structure or other aspects of the sport ball may be applied to various types of inflatable sport balls. In addition to soccer balls, therefore, concepts discussed herein may be incorporated into basketballs, footballs (for either American football or rugby), and volleyballs, for example. A variety of non-inflatable sport balls may also benefit from a textile structure having the configuration disclosed herein. Accordingly, concepts discussed herein may also be incorporated into baseballs, softballs, and golf balls, for example.

Figure 1:
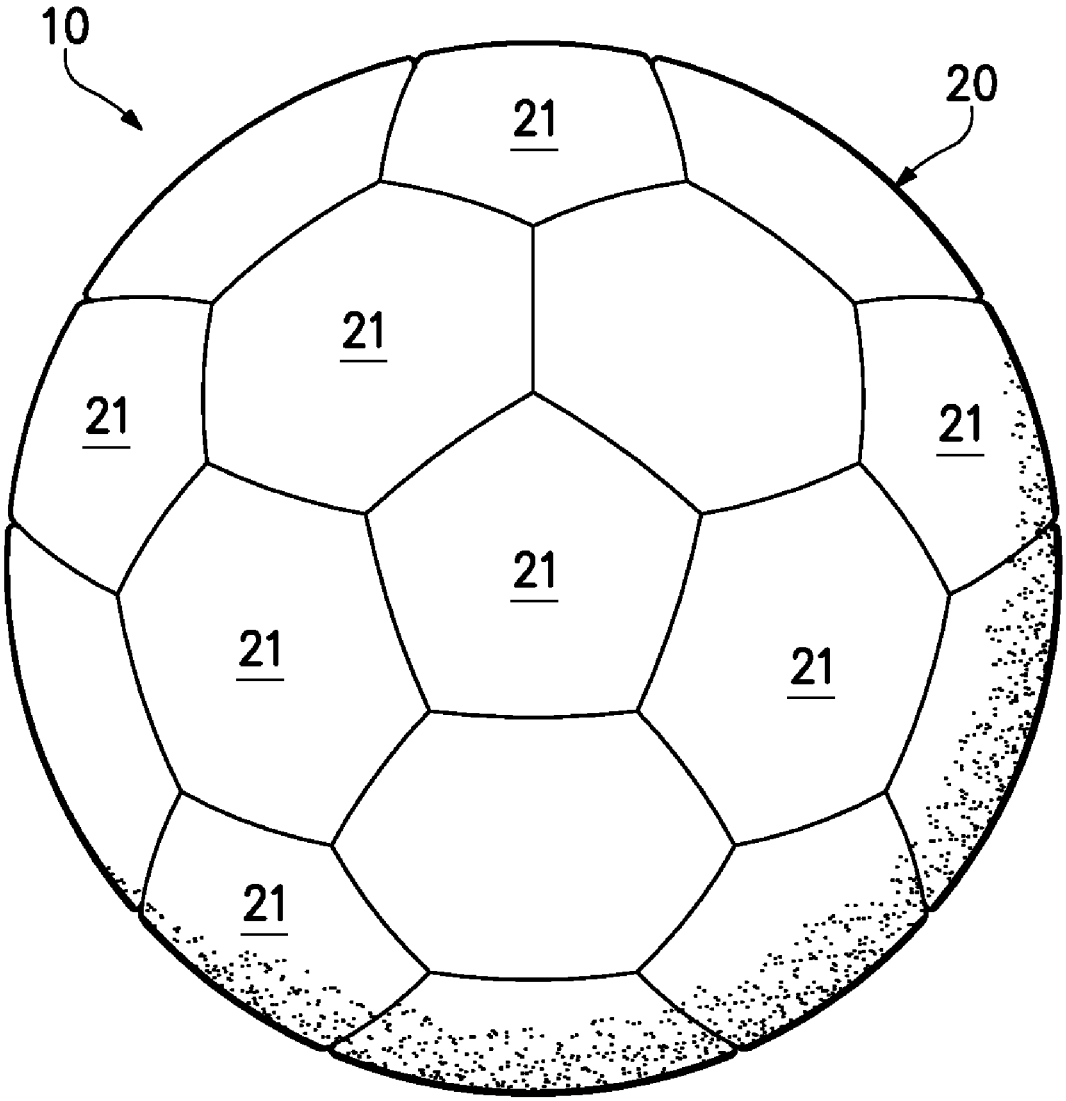
FIG. 1 is a perspective view of a sport ball incorporating a textile restriction structure.
Figure 2:
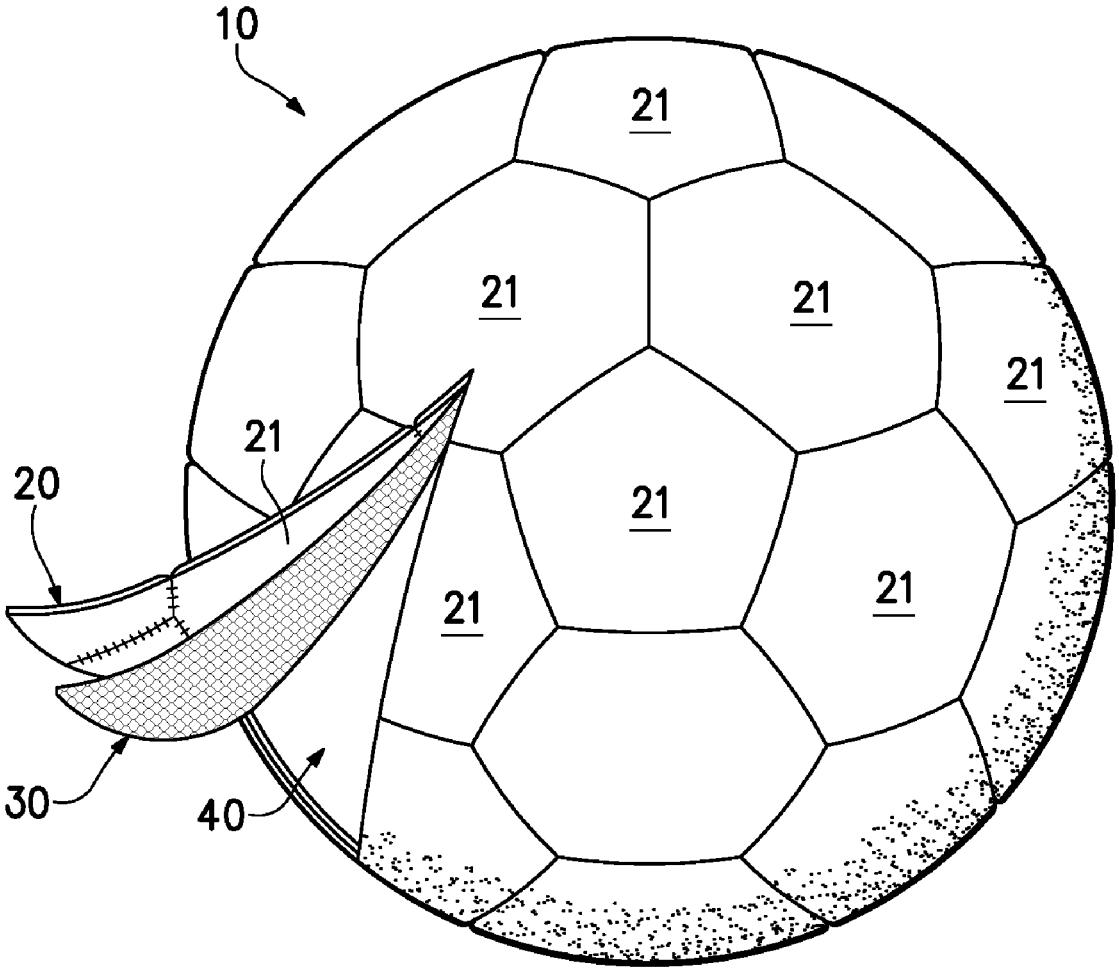
FIG. 2 is another perspective view of the sport ball.

A sport ball 10 having the configuration of a soccer ball is depicted in FIGS. 1 and 2. Ball 10 has a layered structure that includes a casing 20, a restriction structure 30, and an inflatable bladder 40. Casing 20 forms an exterior of ball 10 and is generally formed from various panels 21 that are stitched or otherwise joined together along abutting sides or edges to form an exterior surface of ball 10. Panels 21 are depicted as having the shapes of equilateral hexagons and equilateral pentagons. In further configurations of ball 10, however, panels 21 may have non-equilateral shapes, panels 21 may have concave or convex edges, and selected panels 21 may be formed integral with adjacent panels 21 to form bridged panels that reduce the number of seams, for example. Panels 21 may also have a variety of other shapes (e.g., triangular, square, rectangular, trapezoidal, round, oval) that combine in a tessellation-type manner to form casing 20, and panels 21 may also exhibit non-regular or non-geometrical shapes. In other configurations, casing 20 may have a seamless configuration. The materials selected for casing 20 may be leather, polyurethane, polyvinyl chloride, or other materials that are generally durable and wear-resistant. In some configurations, each of panels 21 may have a layered configuration that combines two or more materials. For example, an exterior portion of each panel 21 may be formed from a polyurethane layer, and an interior portion of each panel 21 may be formed from a polymer foam layer. Accordingly, the configuration of casing 20 may vary significantly to include a variety of configurations and materials.

Restriction structure 30 forms a middle layer of ball 10 and is positioned between bladder 40 and casing 20. As discussed in greater detail below, restriction structure 30 may be formed from a textile material with a limited degree of stretch thereby restricting the expansion of bladder 40. In comparison with some conventional textile restriction structures formed from (a) various panels that are stitched together and have multiple seams or (b) elements arranged in an overlapping configuration, restriction structure 30 may be seamless, have relatively few seams, or a non-overlapping configuration. In addition, restriction structure 30 may be formed from a textile with a non-planar, curved, partially-spherical, spherical, or otherwise three-dimensional configuration that conforms with the curvatures of the interior surface of casing 20 and the exterior surface of bladder 40.

Bladder 40 has an inflatable configuration and is located within restriction structure 30 to provide an inner portion of ball 10. When inflated, bladder 40 exhibits a rounded or generally spherical shape. In order to facilitate inflation, bladder 40 may include a valved opening (not depicted) that extends through restriction structure 30 and casing 20, thereby being accessible from an exterior of ball 10. Bladder 40 may be formed from a rubber material that substantially prevents air or other fluids within bladder 40 from diffusing to the exterior of ball 10. In addition to rubber, a variety of other elastomeric or otherwise stretchable materials may be utilized for bladder 40.

Inflation of bladder 40 induces ball 10 to take on a substantially spherical shape. More particularly, pressure within bladder 40 causes bladder 40 to expand and place an outward force upon restriction structure 30. In turn, restriction structure 30 places an outward force upon casing 20. In order to limit expansion of bladder 40 and also limit tension in casing 20, restriction structure 30 is generally formed from a material that has a limited degree of stretch. In other words, bladder 40 expands within restriction structure 30, but the stretch characteristics of restriction structure 30 effectively prevent the expansion from inducing significant tension in casing 20. Accordingly, restriction structure 30 restrains the expansion of bladder 40, while permitting outward forces to induce a substantially spherical shape in casing 20, thereby imparting a substantially spherical shape to ball 10.

An example of a suitable configuration for restriction structure 30 is depicted in FIGS. 3-6 as being a one-piece textile element with a generally spherical shape. More particularly, restriction structure 30 includes one or more yarns 31 that form a knitted fabric with a generally spherical and seamless configuration. An advantage of forming restriction structure 30 as a one-piece textile element is that restriction structure 30 does not include seams or other structures that join different elements together. In addition to increasing manufacturing efficiency and reducing the mass of ball 10, the absence of seams decreases incongruities in the surfaces of restriction structure 30 that may have an effect upon the overall sphericity of ball 10. That is, the seamless configuration of restriction structure 30 may increase the overall sphericity of ball 10.

An advantage of forming restriction structure 30 with a generally spherical shape is that the textile is pre-formed to have the shapes of the interior surface of casing 20 and the exterior surface of bladder 40. Some conventional restriction structures utilize planar textile elements that bend or otherwise flex to conform with the non-planar surface of a bladder. Bending planar textile elements to conform with the non-planar surface of a bladder cause bunching, folding, overlapping, bulging, or other incongruities in the conventional restriction structures. As with the seamless configuration of restriction structure 30, the absence of bending in restriction structure 30 to conform with curvatures in casing 20 and bladder 40 also decreases incongruities in the surfaces of restriction structure 30 that may have an effect upon the overall sphericity of ball 10. That is, the non-planar, curved, and generally spherical shape of restriction structure 30 may further increase the overall sphericity of ball 10.

Various techniques may be utilized to form restriction structure 30 to have the configuration of a knitted fabric. In general, knitting involves forming courses and wales of intermeshed loops of a yarn or multiple yarns. In production, knitting machines may be programmed to mechanically-manipulate yarns 31 into the configuration of restriction structure 30. That is, restriction structure 30 may be formed by mechanically-manipulating yarns 31 to form a one-piece textile element that has a generally spherical shape. The two major categories of knitting techniques are weft-knitting and warp-knitting. Whereas a weft-knit fabric utilizes a single yarn within each course, a warp-knit fabric utilizes a different yarn for every stitch in a course.

Although restriction structure 30 may be formed through a variety of different knitting processes, an advantage of flat knitting, which is a specific type of weft-knitting, is that generally three-dimensional structures may be produced. In contrast with the "flat" terminology in "flat knitting", therefore, non-planar, curved, or otherwise generally three-dimensional structures may be produced through flat knitting. As discussed above, restriction structure 30 is a one-piece textile element with a generally spherical shape, which may be formed through flat knitting. In general, flat knitting is a method for producing a knitted fabric in which the fabric is turned periodically (i.e., the fabric is knitted from alternating sides). The two sides (otherwise referred to as faces) of the fabric are conventionally designated as the right side (i.e., the side that faces outwards, towards the viewer) and the wrong side (i.e., the side that faces inwards, away from the viewer). Although flat knitting provides a suitable manner for forming restriction structure 30, other types of knitting may also be utilized, including wide tube circular knitting, narrow tube circular knit jacquard, single knit circular knit jacquard, double knit circular knit jacquard, and warp knit jacquard, for example.

Figure 3:
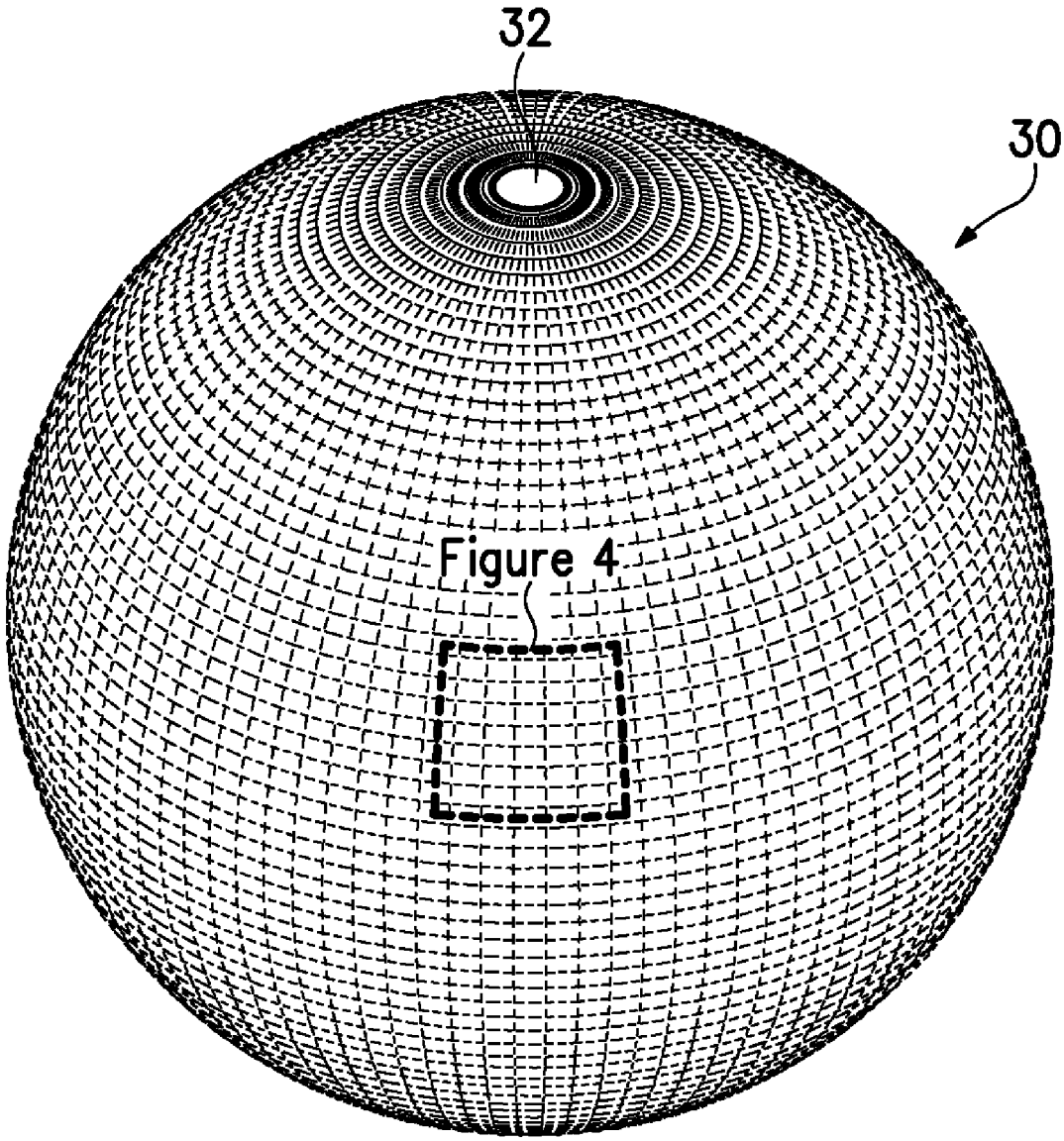
FIG. 3 is a perspective view of the textile restriction structure.
Figure 4:
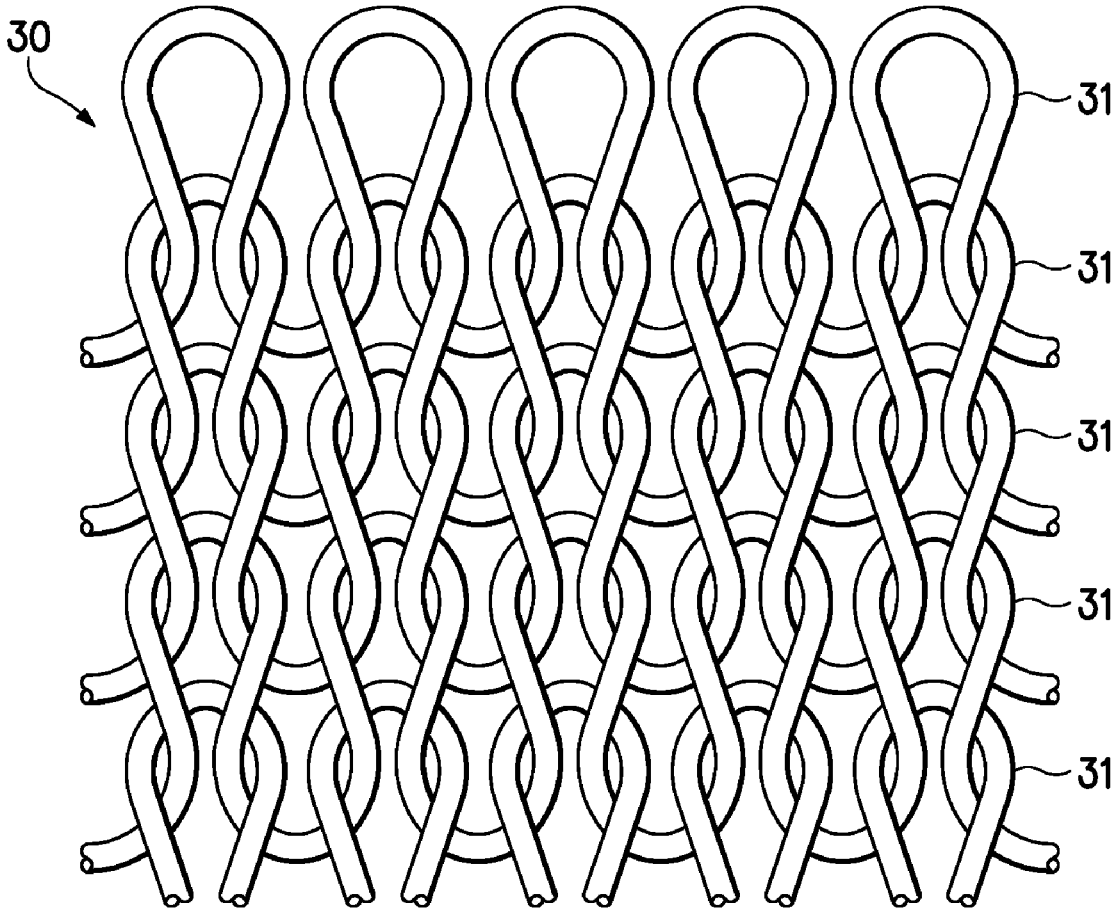
FIG. 4 is an elevational view of a portion of the textile restriction structure, as defined in FIG. 3.
Figure 5:
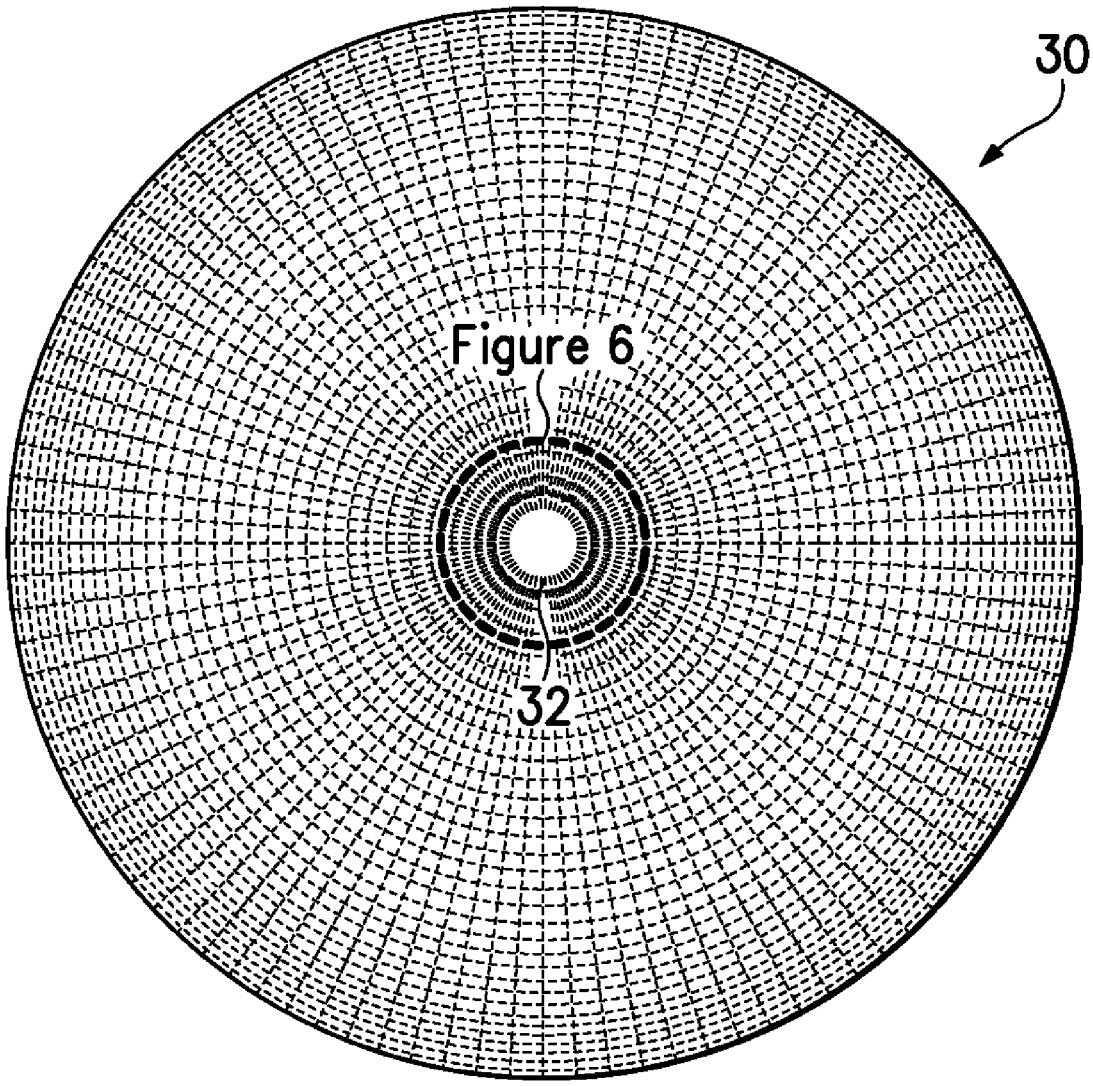
FIG. 5 is a top plan view of the restriction structure.
Figure 6:
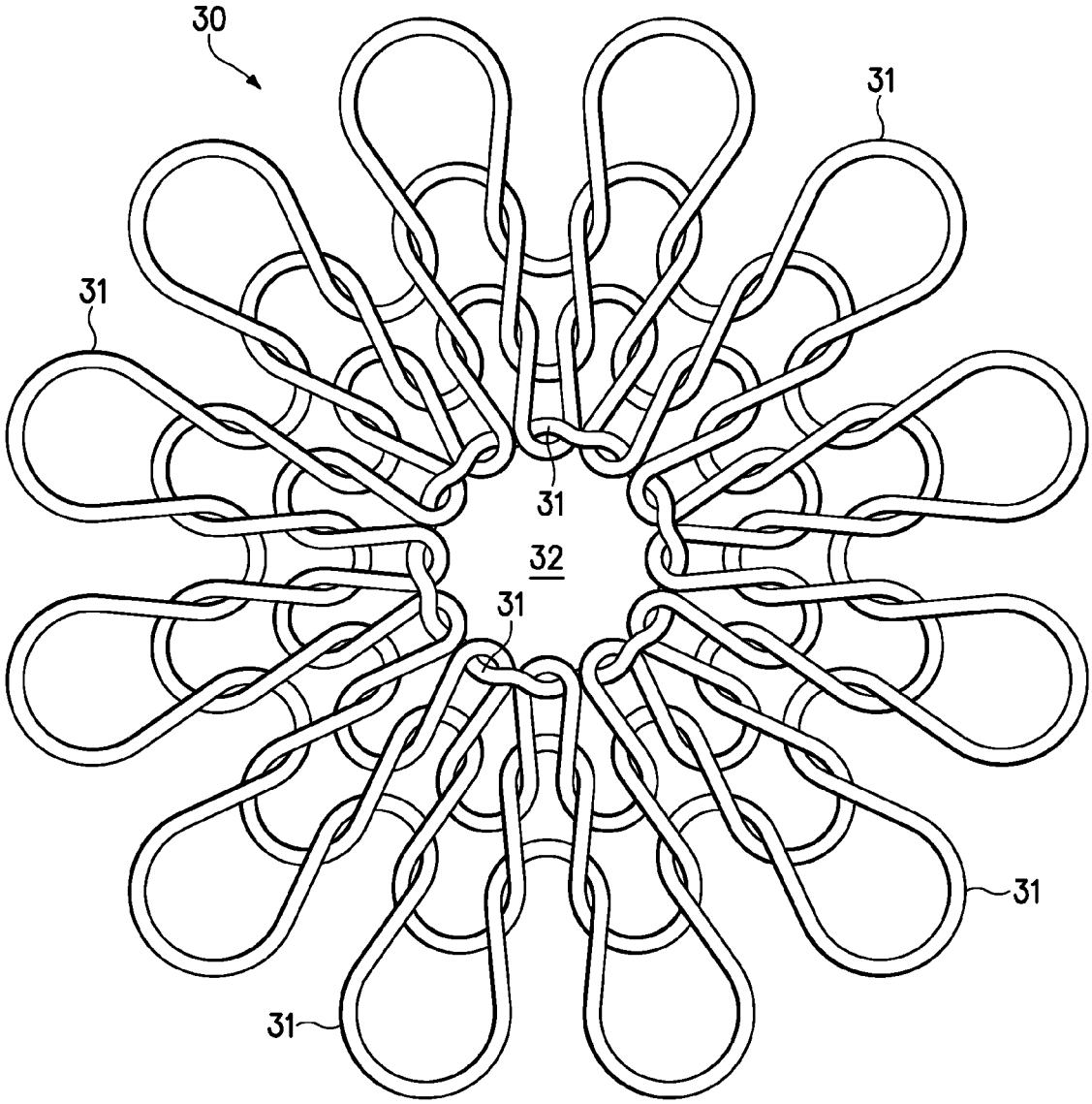
FIG. 6 is a top plan view of a portion of the textile restriction structure, as defined in FIG. 5.

Restriction structure 30 may be formed by mechanically-manipulating yarns 31 to form a plurality of courses and wales. In general, the courses are circular rows of loops that extend entirely around restriction structure 30, and the wales are columns of loops that extend from a top to a bottom of restriction structure 30. A pair of apertures 32, which are each surrounded by one of the courses, may be located at the top and the bottom of restriction structure 30. FIGS. 3 and 4 depict views of restriction structure 30. Referring specifically to FIG. 4, a portion of restriction structure 30 is depicted as having horizontal courses and vertical wales, and the number of wales are approximately the same in each course. As a comparison, FIGS. 5 and 6 depict a top view of restriction structure 30. Referring to specifically to FIG. 6, a portion of restriction structure 30 is depicted as having generally circular courses and also having wales that extend outward in a radial direction from one of apertures 32. In other configurations, the number of wales may increase with each successive course. More particularly, some areas of restriction structure 30 may have a configuration wherein adjacent courses have different numbers of loops of yarns 31 in order to form the generally spherical shape. One manner of forming a three-dimensional, non-planar, curved, partially-spherical, or spherical structure may be to change the number of courses in adjacent wales within a knitted fabric.

One of apertures 32 may be utilized for locating bladder 40 within restriction structure 30. Once bladder 40 is properly placed, various methods may be utilized to close apertures 32. Moreover, the valved opening of bladder 40 may extend through one of apertures 32. In some configurations, one of apertures 32 may be formed to be larger than the other aperture 32 in order to provide a larger opening for inserting bladder 40. In other configurations, one or both of apertures 32 may be absent from restriction structure 30.

Whereas edges of many textile materials are cut to expose ends of the yarns, apertures 32 may be formed to have a finished configuration. An advantage of the finished configuration is that the yarns forming the edges of apertures 32 are less likely to unravel, thereby degrading the structure of restriction structure 32. That is, the finished configuration of apertures 32 may enhance the durability of restriction structure 32.

For purposes of the present discussion, the term "yarn" or variants thereof is intended to encompass a variety of generally one-dimensional materials (e.g., filaments, fibers, threads, strings, strands, and combinations thereof) that may be utilized to form a textile. The properties of restriction structure 30 relate to the specific materials that are utilized in yarns 31. Examples of properties that may be relevant in selecting specific materials for yarns 31 include tensile strength, tensile modulus, density, flexibility, tenacity, resistance to abrasion, and resistance to degradation (e.g., from water, light, and chemicals). Examples of suitable materials for yarns 31 include rayon, nylon, polyester, polyacrylic, silk, cotton, carbon, glass, aramids (e.g., para-aramid fibers and meta-aramid fibers), ultra high molecular weight polyethylene, and liquid crystal polymer. Although each of these materials exhibit properties that are suitable for restriction structure 30 and yarns 31, each of these materials exhibit different combinations of material properties. Accordingly, the properties of yarns formed from each of these materials may be compared in selecting materials for yarns 31 within restriction structure 30. Moreover, factors relating to the combination of yarns 31 and the type of knit or type of textile may be considered in selecting a configuration for restriction structure 30.

As discussed above, restriction structure 30 is generally formed from a material that has a limited degree of stretch in order to effectively prevent the expansion of bladder 40 from inducing significant tension in casing 20. In some configurations, restriction structure 30 may be formed from materials and with a knit configuration that has relatively little or no stretch. When formed in this manner, restriction structure 30 may be formed to have a diameter that is approximately equal to a diameter of an interior surface of casing 20. In other configurations, restriction structure 30 may be formed from materials and with a knit configuration that stretches. When formed in this manner, restriction structure 30 may have a diameter that is less than the diameter of the interior surface of casing 20. When bladder 40 is inflated, therefore, restriction structure 30 may stretch and expand outward to have a diameter that is approximately equal to the diameter of the interior surface of casing 20. Accordingly, the diameter of restriction structure 30 may vary depending upon the degree to which restriction structure 30 stretches.

Figure 7A:
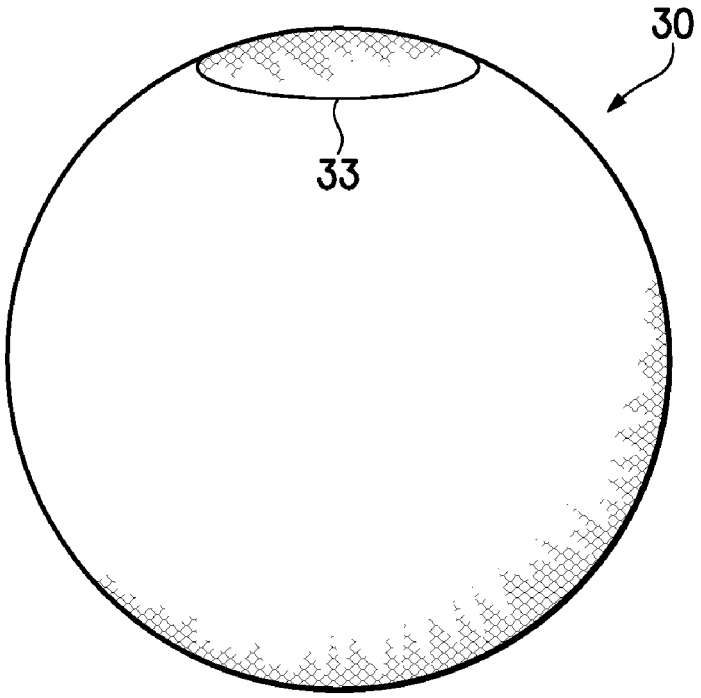
FIGS. 7A-7H are perspective views of additional configurations of the textile restriction structure.

In contrast with some conventional restriction structures, restriction structure 30 is depicted in FIGS. 3-6 as being a one-piece textile element with a generally spherical shape. An advantage of this configuration, as discussed above, is that the overall sphericity of ball 10 may be increased. Some configurations of restriction structure 30 may, however, include various seams that join portions of a single textile element to each other or join two different textile elements to each other. In comparison with the conventional restriction structures, the number of seams in restriction structure 30 may be reduced and the textile elements may have a three-dimensional, non-planar, curved, partially-spherical, or spherical structure. Referring to FIG. 7A, for example, restriction structure 30 is depicted as having a seam 33 located in an upper area. This configuration may permit bladder 40 to be located within restriction structure 30 in a relatively easy manner. Once bladder 40 is located within restriction structure 30, edges of the textile element may be joined with seam 33 to effectively close restriction structure 30. Although seam 33 is present in restriction structure 30, a seamless area of the textile element forming restriction structure 30 covers at least seventy-five percent of the surface of bladder 40, and may cover at least eighty percent or at least ninety-five percent of the surface of bladder 40 depending upon the location of seam 33.

Figure 7B:
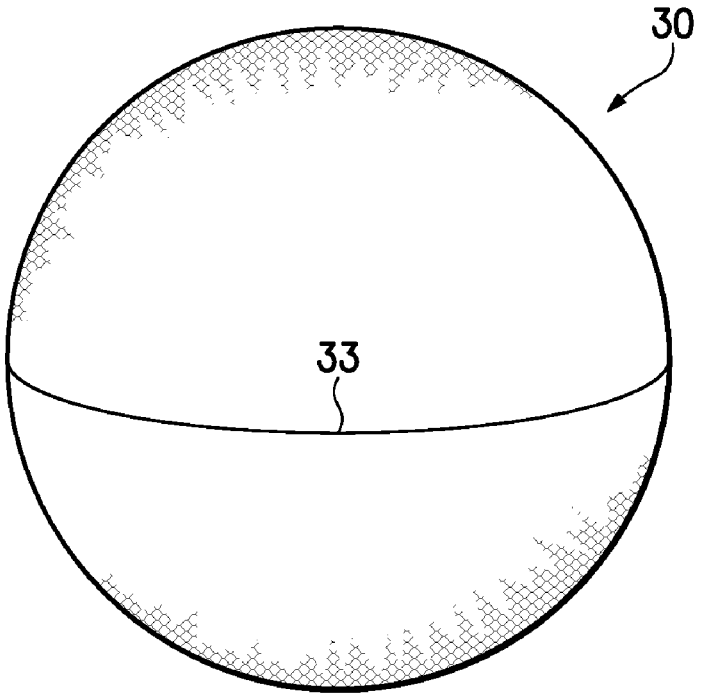
Figure 7C:
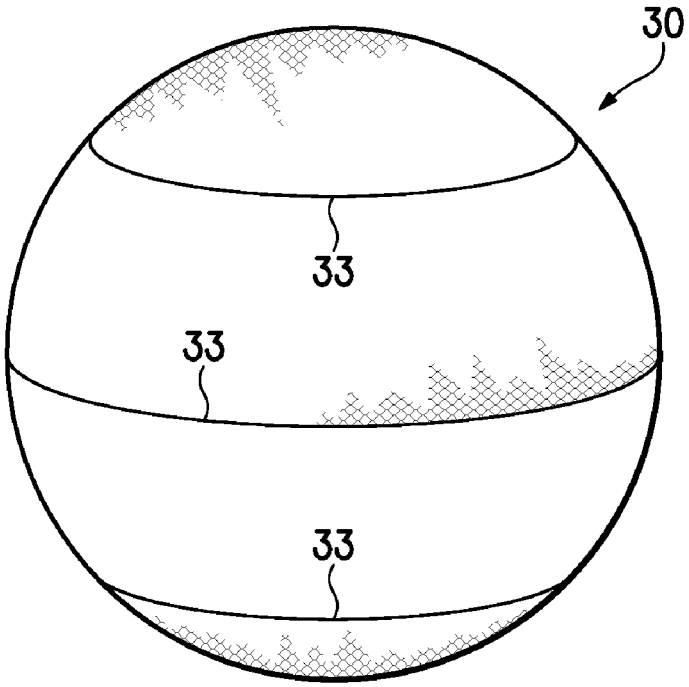
Figure 7D:
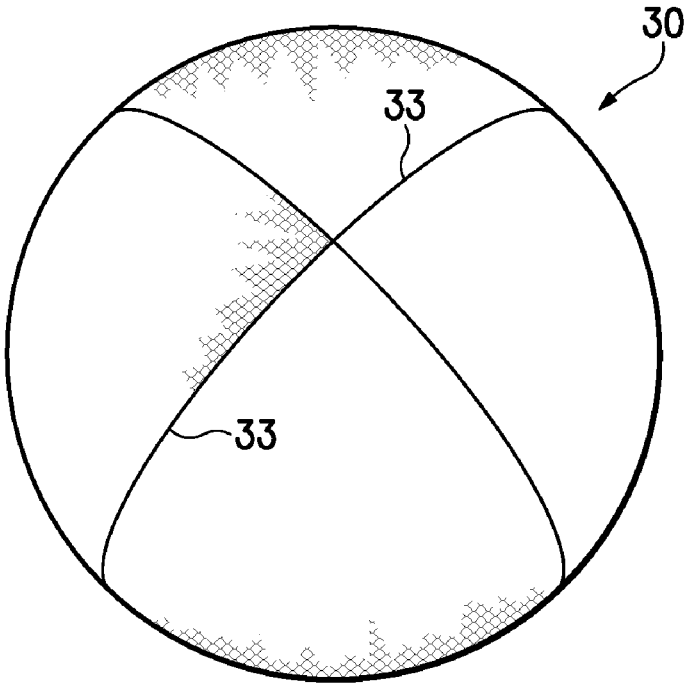
Figure 7E:
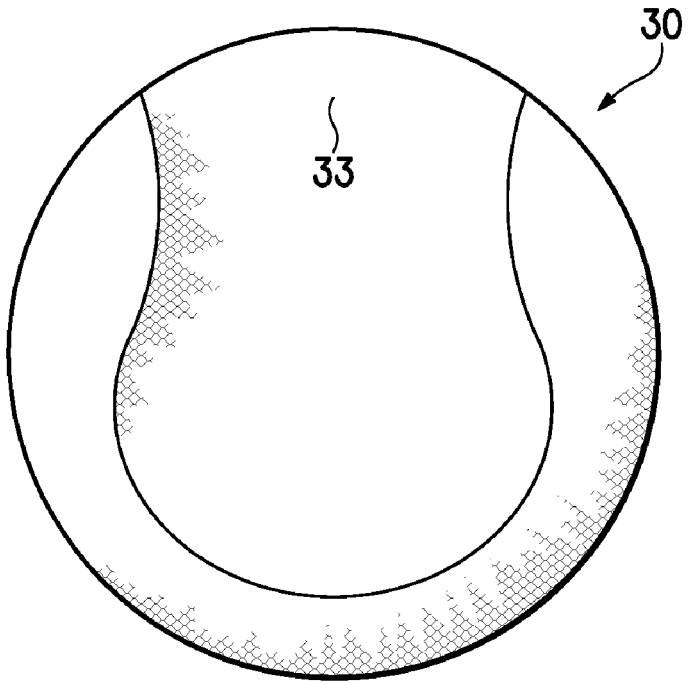
Figure 7F:
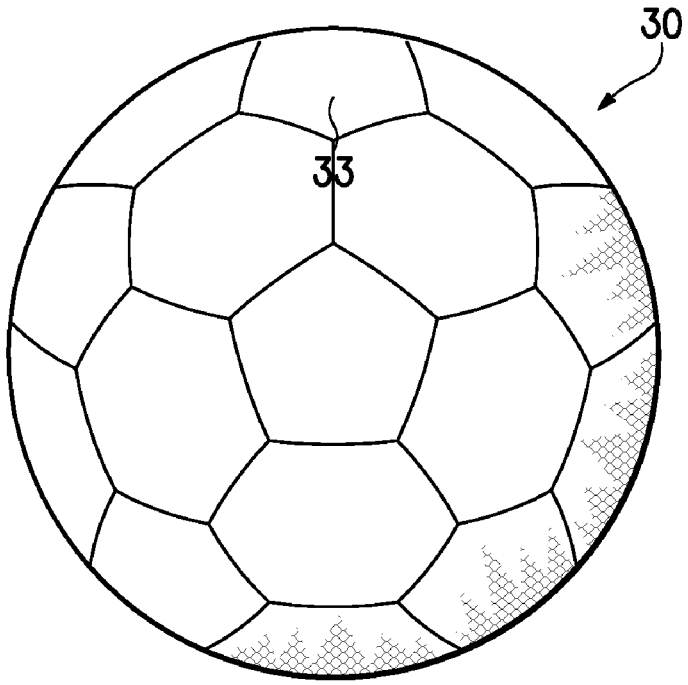
Figure 7G:
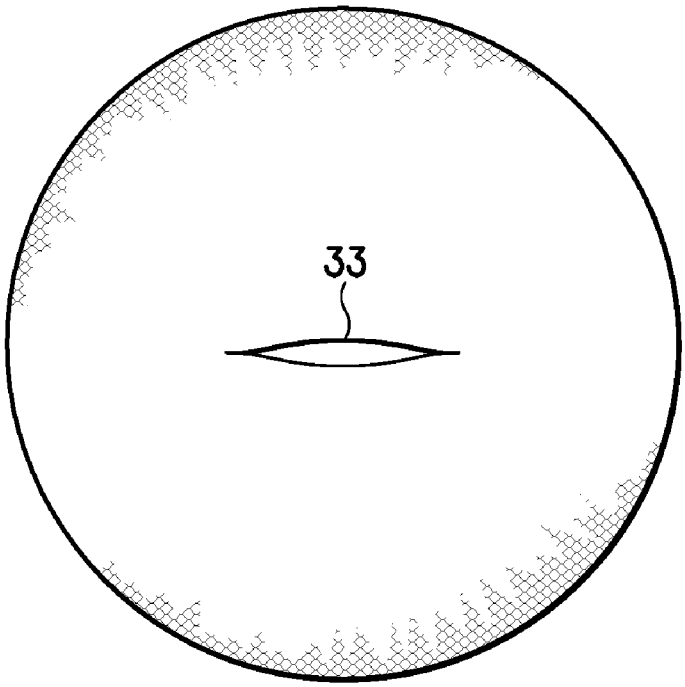
Figure 7H:
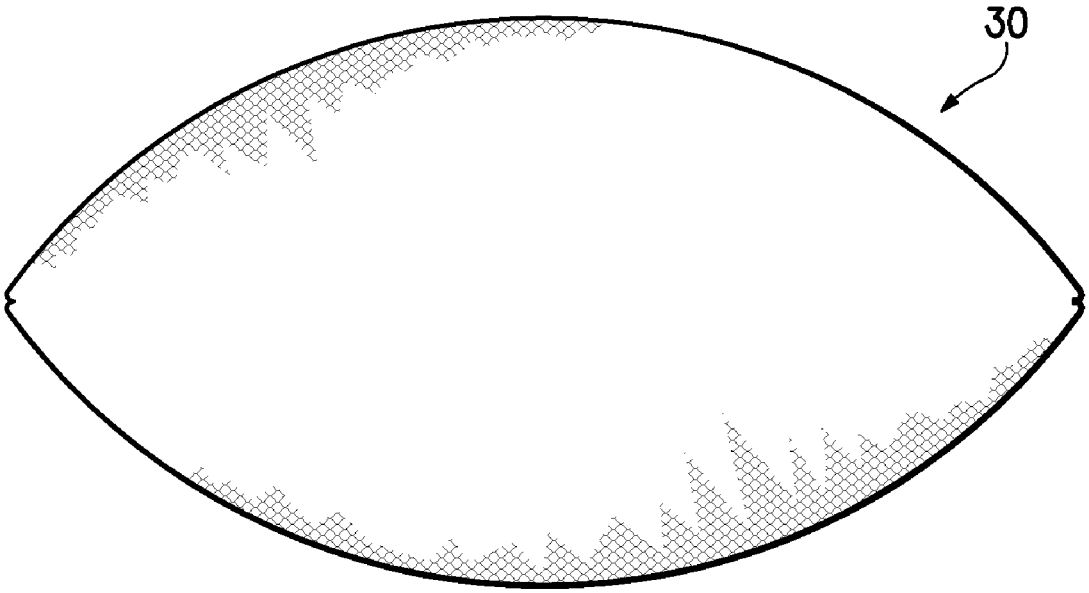

Restriction structure 30 is depicted as having a centrally-located seam 33 in FIG. 7B. In this configuration, restriction structure 30 may be formed from two separate and hemispherical textile elements that are joined by seam 33. Although seam 33 is present in restriction structure 30, seamless areas of the textile elements cover at least thirty or forty percent of the surface of bladder 40, and may cover at least forty-five percent or at least fifty percent of the surface of bladder 40 depending upon the location and configuration of seam 33. In further configurations, three seams 33 may extend around restriction structure 30, as depicted in FIG. 7C, or two seams 33 may cross each other, as depicted in FIG. 7D. In yet another configuration, as depicted in FIG. 7E, a single seam 33 may extend around restriction structure 30 in a pattern that is similar to an exterior seam on a baseball to join two textile elements. As another example, textile elements having pentagonal and hexagonal shapes may be joined with various seams 33, as depicted in FIG. 7F. Additionally, a relatively short seam 33 that provides an opening for inserting bladder 40 may be formed in an otherwise spherical, one-piece, and seamless restriction structure 30, as depicted in FIG. 7G. When ball 10 has the configuration of a football (for either American football or rugby), restriction structure 30 may have an elongate shape that is substantially seamless and is formed to have a three-dimensional, non-planar, or curved configuration. Accordingly, the configurations of seams 33 and the areas covered by seamless portions of textile elements may vary significantly.

Although various seams 33 are depicted in FIGS. 7A-7F, restriction structure 30 retains many of the advantages discussed above. As a first matter, the textile elements forming restriction structure 30 may have a three-dimensional, non-planar, curved, partially-spherical, or spherical structure that does not bunch or form other incongruities in restriction structure 30, thereby increasing the overall sphericity of ball 10. Accordingly, even when seams 33 are present in restriction structure 30, the textile may have a non-planar configuration. As a second manner, the configurations depicted in FIGS. 7A-7E have a relatively small number or length of seams 33, thereby forming relatively large areas of bladder 40 that are covered by a seamless area of restriction structure 30. Moreover, some configurations have at most one seam 33, such as the configurations depicted in FIGS. 7A, 7B, and 7E. Accordingly, even when seams 33 are present in restriction structure 30, the textile may seamlessly cover relatively large areas of bladder 40.

As with the edges of apertures 32, textile edges of the various configurations depicted in FIGS. 7A-7G may also be formed to have a finished configuration that does not expose a significant number of yarn ends. An advantage of the finished configuration is that the yarns forming the edges of the textile in restriction structure 30 are less likely to unravel, thereby degrading the structure of restriction structure 32. That is, the finished configuration of the edges may enhance the durability of restriction structure 32.

Figure 8A:
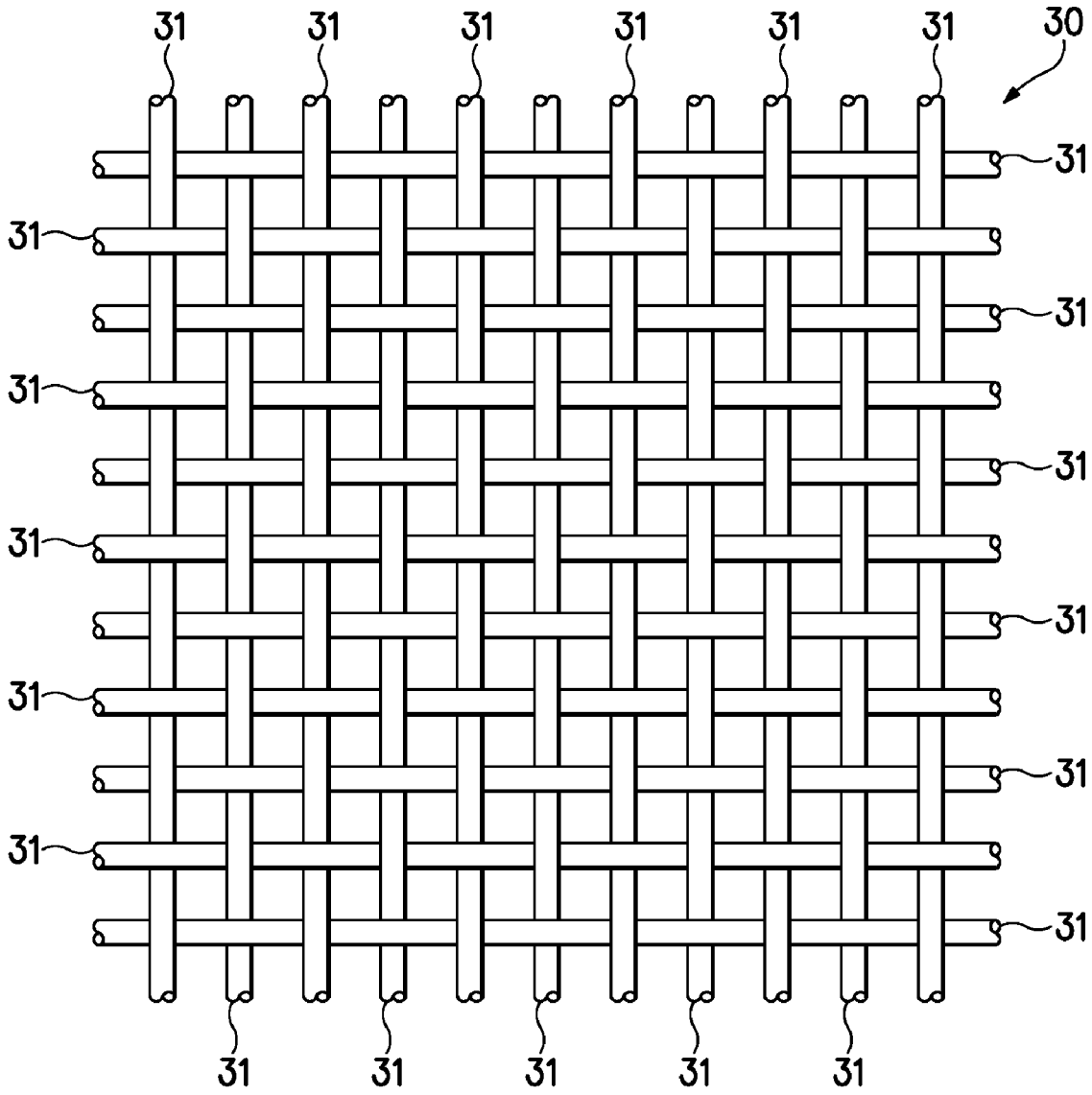
FIGS. 8A and 8B are elevational views of portions of other configurations of the textile restriction structure.
Figure 8B:
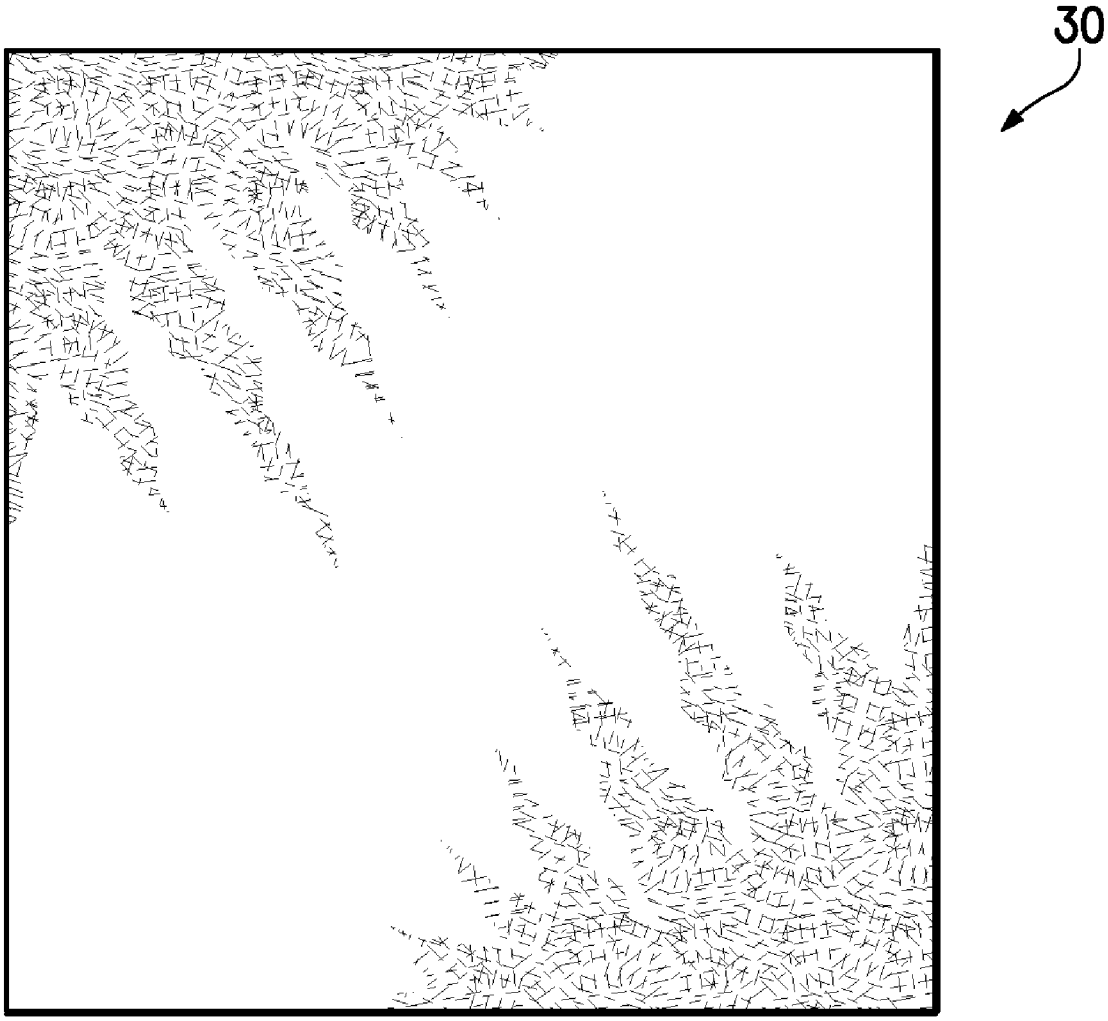

Although knitting provides a suitable method of forming restriction structure 30, various additional techniques may be utilized. As an example, restriction structure 30 may be formed from a woven fabric, in which yarns 31 intersect at right angles, as depicted in FIG. 8A. As another example, restriction structure 30 may be formed from a non-woven material, in which fibers or filaments are randomly deposited, as depicted in FIG. 8B. In manufacturing restriction structure 30 from a non-woven material, the fibers or filaments may be directly deposited onto an inflated bladder 40 or another structure (i.e., a spherical mold) that imparts a spherical or partially-spherical shape. Accordingly, various techniques and methods may be utilized to manufacture a textile suitable for restriction structure 30.

Figure 9:
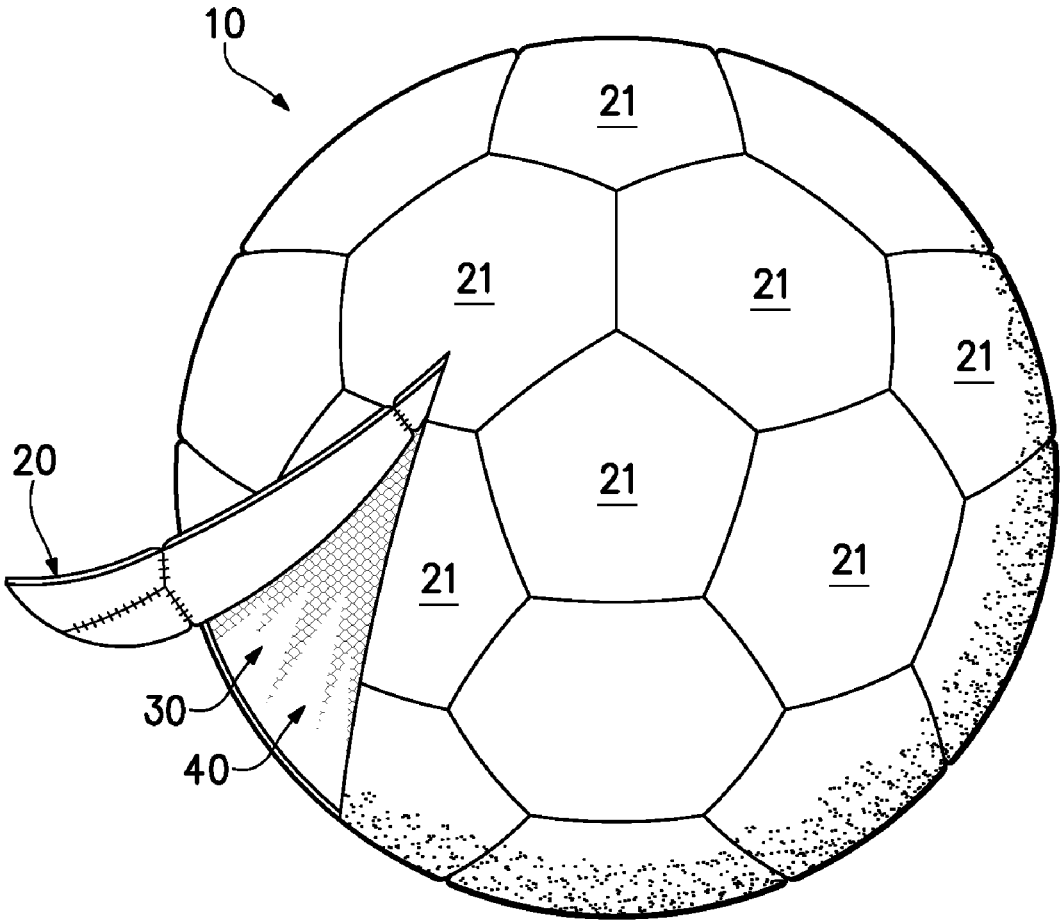
FIG. 9 is a perspective view of another configuration of the sport ball.

In each of the configurations discussed above, restriction structure 30 and bladder 40 are formed as separate layers, with bladder 40 being located within restriction structure 30. With reference to FIG. 9, ball 10 is depicted as having an configuration wherein restriction structure 30 is embedded in or otherwise formed with bladder 40. That is, the textile material of restriction structure 30 is coated with the rubber of bladder 40 to form a single structure that performs the functions of both of restriction structure 30 and bladder 40. In manufacturing the combination, restriction structure 30 may be formed in the manner discussed above, and restriction structure 30 may them be coated with or immersed within the material forming bladder 40, thereby forming a fluid-retaining structure with limited stretch.

The invention is disclosed above and in the accompanying drawings with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A sport ball comprising:

a casing that forms at least a portion of an exterior surface of the ball;

a bladder located within the casing; and a restriction structure located within the casing, the restriction structure including a textile element knitted to have a seamless one-piece portion with a non-planar configuration that covers at least eighty percent of a surface of the bladder, the seamless portion having a plurality of circular courses;

wherein the restriction structure has a pre-formed non-planar configuration shaped to conform with both an interior surface of the casing and an exterior surface of the bladder.

2. The sport ball recited in claim 1, wherein the restriction structure includes at most one seam that joins edges of the textile element.

3. The sport ball recited in claim 1, wherein the seamless portion of the textile element has a configuration of a sphere.

4. The sport ball recited in claim 1, wherein the seamless portion of the textile element has a configuration of a portion of a sphere.

5. The sport ball recited in claim 1, wherein the seamless portion of the textile element covers at least ninety-five percent of a surface of the bladder.

6. The sport ball recited in claim 1, wherein the bladder is located within the restriction structure.

7. The sport ball recited in claim 1, wherein the restriction structure is embedded within a material of the bladder.

8. A sport ball comprising:

a casing that forms at least a portion of an exterior surface of the ball;

a restriction structure located within the casing; and a bladder located within the restriction structure, wherein the restriction structure includes a textile element knitted to have a seamless one-piece portion with a non-planar configuration that covers at least eighty percent of a surface of the bladder, and the restriction structure is substantially free of bunching, folding, and overlapping.

9. The sport ball recited in claim 8, wherein the seamless portion of the textile element covers at least ninety-five percent of the surface of the bladder.

10. The sport ball recited in claim 8, wherein the restriction structure includes at most one seam that joins edges of the textile element.

11. The sport ball recited in claim 8, wherein the seamless portion of the textile element has a configuration of a portion of a sphere.

12. A sport ball consisting of:

a casing that forms at least a portion of an exterior surface of the ball;

a restriction structure located within the casing; and a bladder located within the restriction structure;

wherein the restriction structure is a textile element with a one-piece seamless portion, the seamless portion being knitted into a pre-formed partially-spherical configuration that covers at least eighty percent of a surface of the bladder.

13. The sport ball recited in claim 12, wherein the restriction structure includes at most one seam that joins edges of the textile element.

14. The sport ball recited in claim 12, wherein the seamless portion of the textile element covers at least ninety-five percent of the surface of the bladder.

15. A method of manufacturing a sport ball, the method comprising:

providing an inflatable bladder and a casing;

knitting a textile element with a flat knitting process, the textile element being formed in the flat-knitting process to have a one-piece seamless portion with a non-planar configuration that covers at least eighty percent of a surface of the bladder; and locating the textile element between the inflatable bladder and the casing of the sport ball.

16. The method recited in claim 15, wherein the step of knitting further includes joining the textile element to another textile element with at most a single seam.

17. A method of manufacturing a sport ball, the method comprising:

providing an inflatable bladder and a casing;

utilizing a knitting process to mechanically-manipulate at least one yarn to form a textile element, the knitting process forming the textile element to have a plurality of circular courses, and the knitting process shaping the textile element to have a partially spherical configuration that covers at least eighty percent of a surface of the bladder; and locating the textile element between the inflatable bladder and the casing of the sport ball.

18. The method recited in claim 17, wherein the step of mechanically-manipulating includes forming the textile element with a knitting process.

19. A sport ball comprising:

a casing that forms at least a portion of an exterior surface of the ball;

a bladder located within the casing; and a restriction structure located within the casing, the restriction structure including a textile element having a one-piece seamless portion knitted into a pre-formed non-planar configuration that covers at least eighty percent of a surface of the bladder, the seamless portion having a plurality of circular courses arranged to form the non-planar configuration.

20. The sport ball recited in claim 19, wherein the restriction structure includes at most one seam that joins edges of the textile element.

21. The sport ball recited in claim 19, wherein the seamless portion of the textile element has a configuration of a portion of a sphere.

22. The sport ball recited in claim 19, wherein the seamless portion of the textile element covers at least thirty percent of a surface of the bladder.

23. The sport ball recited in claim 19, wherein the seamless portion of the textile element covers at least ninety-five percent of a surface of the bladder.

* * * * *